United States Patent [19]

Tarnoff et al.

[11] Patent Number: 4,534,264

[45] Date of Patent: Aug. 13, 1985

[54] RECOIL REDUCER

[76] Inventors: Sherwin S. Tarnoff, 3309 N. Mannheim Rd., Franklin Park, Ill. 60131; Mikio Sano, 3319 Manheim Rd., Franklin Park, Ill. 60062

[21] Appl. No.: 482,588

[22] Filed: Apr. 6, 1983

[51] Int. Cl.[3] ..... F41C 21/18
[52] U.S. Cl. ..... 89/14.3
[58] Field of Search ..... 89/14 C

[56] References Cited

U.S. PATENT DOCUMENTS

| | | | |
|---|---|---|---|
| 812,140 | 2/1906 | Kent | 89/14 C |
| 2,589,738 | 3/1952 | Sedberry | 89/14 C |
| 3,808,943 | 5/1974 | Kelly | 89/14 C |

FOREIGN PATENT DOCUMENTS

| | | | |
|---|---|---|---|
| 562475 | 10/1932 | Fed. Rep. of Germany | 89/14 C |
| 832460 | 9/1938 | France | 89/14 C |
| 67 | of 1855 | United Kingdom | 89/14 C |

OTHER PUBLICATIONS

"Star Model F Cal. 22 Pistol", NRA Illustrated Firearms Assembly Handbook, vol. 2, pp. 54–55.

*Primary Examiner*—Stephen C. Bentley
*Attorney, Agent, or Firm*—Paul H. Gallagher

[57] ABSTRACT

The barrel of a firearm is provided with side ports, on opposite sides, adjacent the muzzle. The positioning of the ports, longitudinally of the barrel, is determined according to the pressures of the explosion gases, and the acceleration of the projectile. The acceleration of the projectile occurs in response to, and during, the increase in volume of the explosion gases. This occurs only in a small portion of the length of the barrel, at the breech end, and after that position, the gases decrease in pressure. The recoil occurs after the projectile leaves the barrel and the gases leave the barrel. The side ports are adjacent the muzzle, in the region where the gases have decreased in pressure, and are dimensioned to let nearly all the gases escape by the time the projectile leaves the barrel; they are arranged diametrically opposite each other, and they cancel each other, and greatly reduce and nearly eliminate, the recoil.

2 Claims, 14 Drawing Figures

Fig. 1.
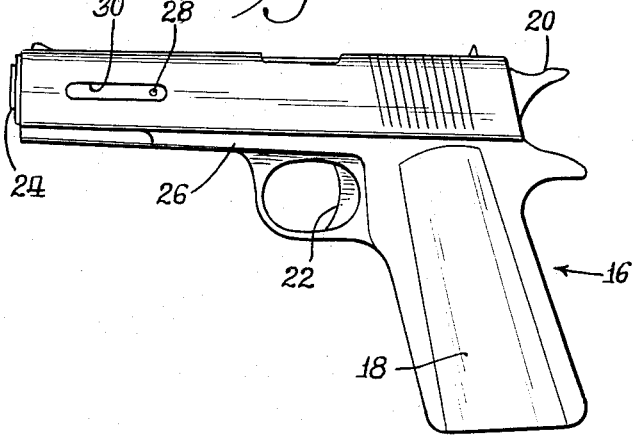
Fig. 2.
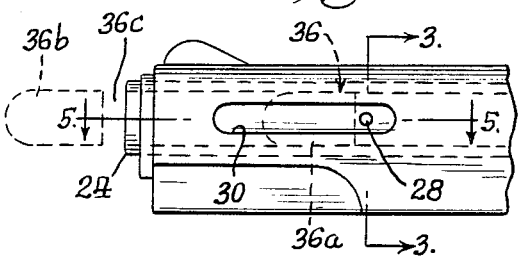
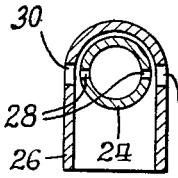
Fig. 3.
Fig. 5.
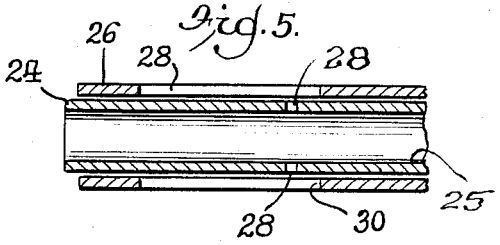
Fig. 4.
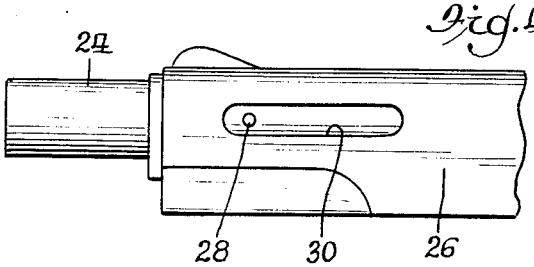
Fig. 6.
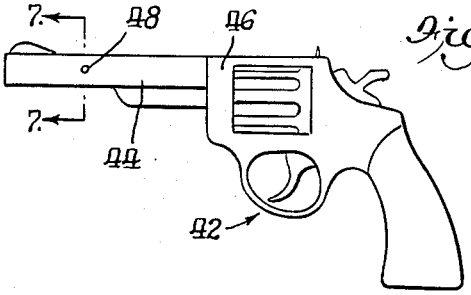
Fig. 7.
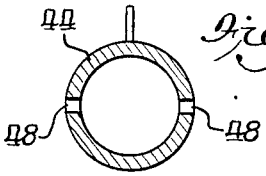
Fig. 8.
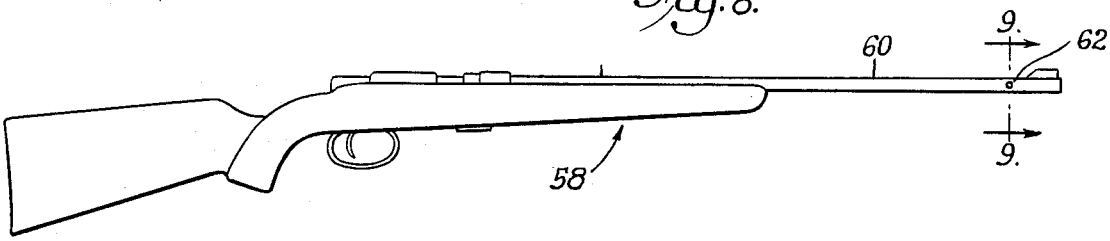
Fig. 9.
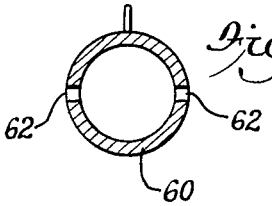
Fig. 10.
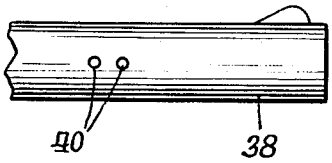

Fig. 11.
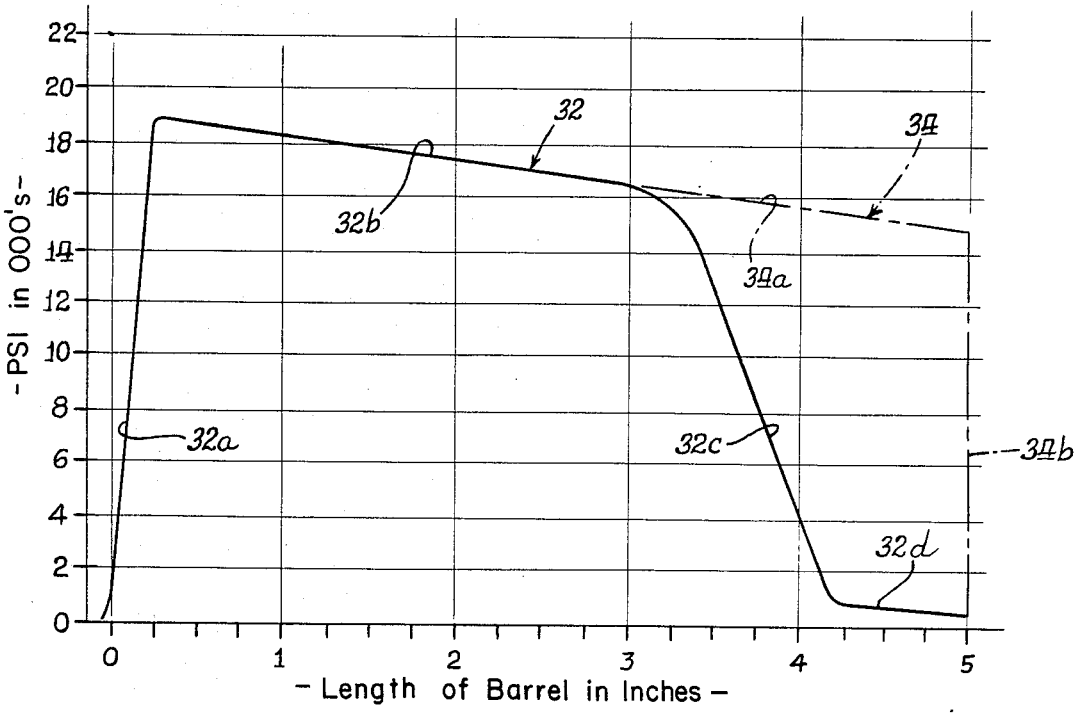
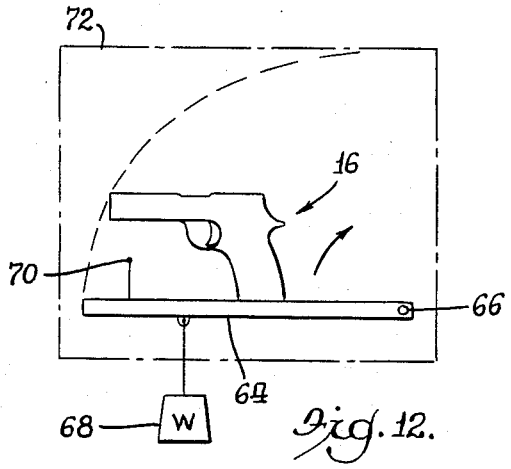
Fig. 12.
Fig. 13.
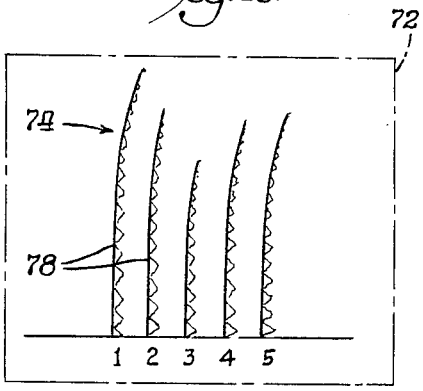
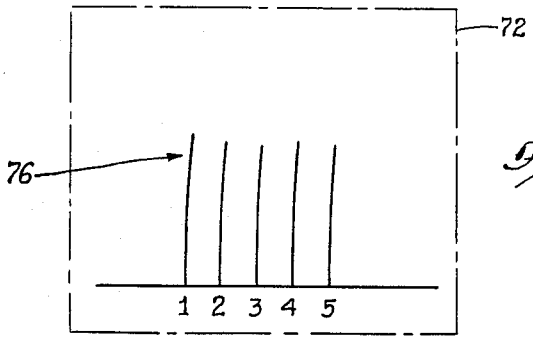
Fig. 14.

RECOIL REDUCER

OBJECTS OF THE INVENTION

A broad object of the invention is to provide construction and method operable for reducing recoil in a firearm.

A more specific object is to provide such firearm and method wherein the reduction of recoil is accomplished by providing release of the explosion gases from the barrel in mutual counteracting and cancelling relation.

A still more specific object is to provide the foregoing independently of the emergence of those gases from the muzzle, and before the projectile leaves the barrel, where heretofore the cause of the recoil resided.

DESCRIPTION OF CERTAIN PREFERRED EMBODIMENTS

In the drawings,

FIG. 1 is a side view of an automatic pistol incorporating the features of the invention;

FIG. 2 is a large-scale detail view of the left end portion of FIG. 1;

FIG. 3 is a sectional view taken at line 3—3 of FIG. 2;

FIG. 4 is a view similar to FIG. 2 but showing the shroud in retracted position;

FIG. 5 is a sectional view taken at line 5—5 of FIG. 2;

FIG. 6 is a side view of a revolver embodying the invention;

FIG. 7 is a sectional view taken at line 7—7 of FIG. 6;

FIG. 8 is an elevational view of a rifle embodying the invention;

FIG. 9 is a view taken at line 9—9 of FIG. 8;

FIG. 10 is a fragmentary view of the muzzle end portion of the barrel of a firearm showing a modified form of construction thereof;

FIG. 11 is a graph representing pressures of the explosion gases in the barrel of the firearm;

FIG. 12 is a diagrammatic representation of an arrangement for testing and recording recoil;

FIG. 13 shows recording marks produced by a weapon as tested in the device at FIG. 12, without the present invention; and FIG. 14 shows recording marks produced by a weapon as tested in the device at FIG. 12, with the present invention.

The overall concept of the invention is based on the feature that the recoil caused by the explosion gases does not occur until after the projectile leaves the barrel. The pressure of the gases in the barrel initially increases greatly, before the projectile leaves the barrel, but after a very short interval, the pressure decreases, and continues to decrease until the projectile leaves the barrel, and then they pass out through the muzzle explosively, and this last step produces the recoil.

The main concept of the present invention is to provide release of those explosion gases in mutual counteracting effect, and thereby without recoil effect on the barrel, and before the projectile leaves the barrel.

FIGS. 1–5 show an automatic pistol of known kind, except for the provision for the release of the explosion gases. The pistol is indicated in its entirety at 16 and includes a stock 18, a hammer 20, a trigger 22, and a barrel 24 having a bore 25 of uniform diameter. In the case of such automatic pistol, the pistol is provided with a shroud 26 enclosing, or nearly enclosing, the barrel, when it is in normal position, (FIG. 1), but upon firing the weapon, the shroud retracts, as shown in FIG. 4, in a known manner. All of the foregoing are known features incorporated in an automatic pistol.

The automatic pistol of FIGS. 1–5 is provided with the construction of the present invention, which includes diametrically opposed side ports 28 in the barrel and side slots 30 in the shroud. The slots 30 are elongated so as to be constantly in register with those ports, throughout the movement of the shroud between its normal and retracted positions.

The side ports 28 constitute the only ports in the barrel communicating with the bore 25. They are located adjacent the muzzle of the barrel, in a position relative thereto in accordance with the pressures of the explosion gases encountered in the barrel, as referred to specifically hereinbelow, and slots 30 are necessarily adjacent the fore end of the shroud.

Attention is directed next to FIG. 11 which is a graph showing various pressures of the explosion gases in the barrel. This graph shows the numerals 0 to 5 at the bottom representing the length of the barrel in inches. A 5″ barrel is a common size, and for convenience reference is made to that size barrel although of course, it will be understood that any dimension or size barrel may be utilized and other features arranged in proportion both as to position and dimensions. The numerals at the left edge going from 0 to 22 in upward direction represent pounds pressure per square inch, in thousands. The numbers in horizontal direction may be converted to time, although time in itself is not involved separate from the movement of the projectile through the barrel.

Referring in detail to FIG. 11, the graph includes a main curve 32 and a secondary curve 34. Before the detonation of the firing charge, the pressure in the barrel is of course 0 which is indicated at the bottom, left, in the graph. Upon detonation, the pressure increases precipitously, going to a maximum of in the neighborhood of 19,000 psi, which is shown in the portion 32*a* of the main curve. This pressure is developed in approximately the first 0.30″ travel of the projectile, or about 6% of the length of the barrel.

In that first increment of movement of the projectile, the rate of acceleration increases, but after that point, represented by the portion 32*a* of the curve, the rate of acceleration decreases. This step in the procedure is represented by the portion 32*b* of the curve which slopes in accordance with the reduction of the pressure of the gases as the projectile moves along in the barrel. This portion 32*b* of the curve is substantially straight, and extending from this portion is another portion 34*a* of the curve 34, which constitutes substantially a straight extension of the portion 32*b*. The curve portions 32*b*, 34*a*, continue to point 5, in the scale at the bottom, which is the end of the barrel, and the curve 34 simply terminates as indicated at 34*b*. At this point, the explosion gases are dispersed abruptly to the exterior.

Referring again to the feature that the recoil to the weapon is produced by the explosion gases as, and after, the projectile leaves the barrel, attention is directed to FIG. 2 where a projectile 36 is indicated in each of two positions, 36*a* within the barrel, and 36*b* just emerging from barrel, and a space 36*c* is referred to for convenience, between the muzzle and the projectile just after the projectile has left the barrel. It is unnecessary to enter into the details of the exact manner in which the recoil is produced.

The concept of the present invention is based on that phenomenon, whereby the explosion gases can be released from the barrel before the projectile leaves the barrel, without impairing the movement of the projectile, and that step is so utilized. The recoil action takes place in direction opposite to the direction of movement of the gases. In the case of the gases emerging from the muzzle, all the action is in the single reverse direction, i.e. along the axis, or the length, of the barrel. In the present instance, the ports 28 in the barrel enable the gases to escape and they are directed opposite to each other, whereby they produce a mutually counteracting and cancelling effect, that is, the tendency to recoil produced by the gases in each of the ports is counteracted by the opposite tendency from those escaping from the other port.

The curve 32 includes a third portion or segment 32*c* which represents the reduction of pressure from the barrel due to the ports 28. The ports are located, in this instance, at a point about 0.61 of the length of the barrel, or a distance of about 3.05". The gases continue to escape through the ports 28, in this instance, to a point about 0.82 of the length of the barrel or about 4.1" from the breech end. At the latter position, the explosion gases have been nearly all depleted, as indicated by the portion 32*d*, and the projectile continues in the barrel until it leaves the muzzle which in this case is about 0.78" beyond the ports. In this condition, as the projectile leaves the muzzle, the pressure is on the order of 200–300 psi or a very small fraction of the pressures involved in the corresponding condition in weapons existing heretofore, which as indicated in the graph at the juncture of the portions 34*a*, 34*b*, is in the neighborhood of 14,500 pounds psi. Although that pressure is not maximum, it is nevertheless immense, and it produces the great recoil.

The dimension and location of the side ports 38 are not critical and may be within a wide range. In actual tests, the results of which will be referred to again hereinbelow, the ports 28 are on the order of 1/16 inch diameter. This dimension is such as to allow the gases to escape according to the pattern desired, and referred to above. The side slots 30 also are of convenient dimensions, sufficient to completely accommodate the movement of the gases escaping, and not impede them, and in the present construction these slots are about 3/16 inch wide, and they are, of course, of the length of the movement of the shroud. plus the dimension of a port. These ports and slots were of such size as embodied in a 45 caliber pistol, having a barrel 5 inches long.

FIG. 10 shows a barrel 38 of a weapon having a plurality of ports 40, such as two, on each side of the barrel. In forming the ports, in addition to providing the cross-sectional area, and capacity, to accommodate the gases, attention must be given to the strength of the barrel, and if it is found that any certain ports dimensioned to provide the necessary cross-sectional area may impair the structure of the barrel, a plurality of the pairs of ports instead of a single pair may be provided.

The invention is equally adaptable to firearms other than pistols, having barrels which are always exposed, that is, not having a shroud over the barrel. FIG. 6 shows a revolver 42 of known kind, having a barrel 44 which is constantly exposed beyond the rear structural frame 46. Side ports 48 (see also FIG. 7) are provided in the side wall portions of the barrel with identical effect produced by those in the first form. The dimensions and locations of the ports 48 are according to the desired capacity and time of action relative to the movement of the projection through the barrel.

The invention is likewise applicable to other types of weapons, such as the rifle 50 shown in FIGS. 8 and 9. The rifle has a barrel 60 constantly exposed, i.e., without a shroud, and side ports 62 are provided adjacent the muzzle, with the same effect as that provided in the first two forms of the invention.

Although the basic recoil produced on the weapon is rearwardly along the axis of the barrel, the weapon tends to jump upwardly. This upward movement is caused by several factors, such as the shape of the stock of the weapon, i.e. it is held in the hand at an effective position below the barrel, which causes the weapon to pivot about transverse axis adjacent the lower end of the stock. Also as a pistol or revolver is held in the shooter's hand, the forearm, in response to the recoil, tends to swing upwardly about the elbow as an axis. This upward movement does of course greatly interfere with the aiming actions. The embodiment of the present invention in firearms has produced results that are believed to be phenomenal, in reducing the recoil.

Tests have been conducted by Vulcan Enterprises. FIG. 12 shows diagrammatically a kind of device utilized for making the tests. The firearm, which may be the pistol 16, is mounted rigidly on an arm 64 pivoted at 66 and having a weight 68 thereon. Also mounted on the arm 64 was a marker 70 arranged to form a mark on a chart 72. The tests were conducted in two forms, both with an ordinary barrel, and with a barrel having the side ports 28 therein. The same weapon was utilized in all cases and the only change made was substitution of the barrel. In both cases, cartridges were taken at random from a single box of cartridges purchased on the market, i.e. there were five cartridges fired with the old barrel and five with the new barrel. In the case of the old or prior art barrel, without the side ports, there was a recoil of the weapon represented by the marks 74 of FIG. 13. These marks are five in number representing the five cartridges fired; they are of different heights formed by charges of different values as found in cartridges randomly selected from a common group or supply from a single lot.

Five cartridges were similarly selected from the same lot or box and fired with the new barrel, i.e. the barrel provided with the side ports 28, in the same weapon 16. In firing the second lot of five cartridges with the side ports in the barrel, marks were made, identified 76 in FIG. 14. These marks are reproduced herein on the same scale as the marks 74 and it will be seen that the recoil is substantially less. Over a plurality of tests, it has been found that the recoil in cases where the present invention is utilized, is in the neighborhood of 40% of the recoil of weapons heretofore used.

In addition to the length, i.e. height, of the marks 74, 76, the marks 74 made in the case of the prior art weapon, not only are longer, but they include irregular marks, or points, 77 representing shock waves. Such shock waves habitually occurred in the recoil of previous weapons. In the case of the marks 76 in FIG. 14, no such shock waves occur. Accordingly, not only is the direct axial, or longitudinal, recoil greatly reduced, but the aberrations thereof are also greatly reduced. These aberrations producing a great effect in recoil, and because of their absence, the total recoil is much less severe.

The great advantage of the present invention results from the counteracting or cancelling effect of the gases that are released oppositely through the ports 28. There have been many attempts at eliminating or reducing recoil heretofore, and a particular one that is noted is provided by Mag-na-port, as covered by U.S. Pat. No. 3,808,943. In that construction, it was attempted to reduce recoil by providing ports on the upper side of the barrel adjacent the muzzle. The intended effect of this was that as the gases escaped through this port, the reaction therefrom was in downward direction, and this reaction was intended to counteract the overall tendency of the weapon to move upwardly in recoil, as described hereinabove. In that arrangement there was actually an additional movement produced, but in the present case, there is no added recoil, but a cancellation thereof, and regardless what pressures are involved, and whether they vary from one cartridge to the next, the gases emerging from the side ports are counteracted or cancelled, and any variation in the charges would have exactly the same effect in both of those opposite directions.

We claim:

1. A firearm, of automatic piston type, utilizing a cartridge having a propellant and a projectile, and mechanism for firing the cartridge, and including a barrel having a uniform diameter bore through which the projectile is propelled by the gases of explosion of the propellant, and further, having a shroud slidable on the barrel with a normal position closely adjacent the muzzle and retractable rearwardly therefrom, wherein, the barrel is provided with ports adjacent the muzzle thereof capable of releasing explosion gases from the barrel in mutual counteracting effect, independently of the emergence of the gases from the muzzle, the shroud has ports aligned with the ports in the barrel, the ports in the barrel are positioned at the sides of the barrel, diametrically opposite each other, at the uniform diameter portion of the bare and adjacent to the muzzle of the barrel, and the ports in the shroud are in the form of slots elongated longitudinally of the barrel whereby to provide registration with the side ports throughout the retracting movement of the shroud.

2. A firearm according to claim 1 wherein the shroud has depending walls on opposite sides thereof and of the barrel, and wherein, the elongated slots are in the side walls and the side ports in the barrel are in the sides of the barrel.

* * * * *